US007845751B2

(12) United States Patent
Rueby

(10) Patent No.: US 7,845,751 B2
(45) Date of Patent: Dec. 7, 2010

(54) NONUNIFORM MASK CIRCULATION FOR IRREGULAR PAGE ADVANCE

(75) Inventor: Christopher Rueby, North Chili, NY (US)

(73) Assignee: Eastman Kodak Company, Rochester, NY (US)

( * ) Notice: Subject to any disclaimer, the term of this patent is extended or adjusted under 35 U.S.C. 154(b) by 233 days.

(21) Appl. No.: 12/251,858

(22) Filed: Oct. 15, 2008

(65) Prior Publication Data

US 2010/0091051 A1 Apr. 15, 2010

(51) Int. Cl.
*B41J 29/393* (2006.01)

(52) U.S. Cl. ..... 347/19; 347/15; 347/41; 358/1.2

(58) Field of Classification Search ..... 347/15, 347/19, 41, 105; 358/1.2, 1.9
See application file for complete search history.

(56) References Cited

U.S. PATENT DOCUMENTS

| | | | | |
|---|---|---|---|---|
| 6,336,702 | B1 | 1/2002 | Zapata et al. | |
| 6,523,936 | B2 * | 2/2003 | Zapata et al. | 347/41 |
| 6,688,726 | B2 * | 2/2004 | Bauer | 347/41 |
| 6,866,358 | B2 | 3/2005 | Masuyama et al. | |
| 7,503,641 | B2 * | 3/2009 | Nino | 347/41 |
| 2007/0201054 | A1 | 8/2007 | Billow et al. | |

* cited by examiner

*Primary Examiner*—Lamson D Nguyen
(74) *Attorney, Agent, or Firm*—Stephen H Shaw

(57) ABSTRACT

A method for reducing banding artifacts in a printed image, including irregularly advancing a media that will be printed upon while employing an entire single mask for marking elements of a printhead; and calculating a difference between an irregular advance amount of the media versus a nominal advance amount of the media. Finally, the single mask is nonuniformly circulated by the difference calculated in order to compensate for the media being irregularly advanced.

10 Claims, 11 Drawing Sheets

| ROW IN SECTION | ROW IN MASK | a | b | c | d | e | f |
|---|---|---|---|---|---|---|---|
| A1 | 1 | 0 | 0 | 0 | 1 | 0 | 0 |
| A2 | 2 | 1 | 0 | 0 | 0 | 1 | 0 |
| A3 | 3 | 0 | 1 | 0 | 0 | 0 | 0 |
| B1 | 4 | 1 | 0 | 1 | 0 | 1 | 0 |
| B2 | 5 | 0 | 1 | 0 | 1 | 0 | 1 |
| B3 | 6 | 1 | 0 | 1 | 0 | 1 | 0 |
| C1 | 7 | 0 | 1 | 0 | 0 | 0 | 1 |
| C2 | 8 | 0 | 0 | 1 | 0 | 0 | 0 |
| C3 | 9 | 0 | 0 | 0 | 1 | 0 | 1 |

410 418 419

| | | | | | | | | | |
|---|---|---|---|---|---|---|---|---|---|
| A1 | | | | | | | | | 0 |
| A2 | | | | | | | | | 1 |
| A3 | | | | | | | | | 2 |
| B1 | | | | | | | | | 3 |
| B2 | A2 | | | | | | | | 4 |
| B3 | A3 | C3 | | | | | | | 5 |
| C1 | B1 | A1 | | | | | | | 6 |
| C2 | B2 | A2 | | | | | | | 7 |
| C3 | B3 | A3 | | | | | | | 8 |
| | C1 | B1 | A1 | | | | | | 9 |
| | C2 | B2 | A2 | | | | | | 10 |
| | C3 | B3 | A3 | | | | | | 11 |
| | A1 | C1 | B1 | | | | | | 12 |
| | | C2 | B2 | A2 | | | | | 13 |
| | | | B3 | A3 | C3 | | | | 14 |
| | | | C1 | B1 | A1 | | | | 15 |
| | | | C2 | B2 | A2 | | | | 16 |
| | | | C3 | B3 | A3 | | | | 17 |
| | | | | C1 | B1 | A1 | | | 18 |
| | | | | C2 | B2 | A2 | | | 19 |
| | | | | C3 | B3 | A3 | | | 20 |
| | | | | A1 | C1 | B1 | | | 21 |
| | | | | | C2 | B2 | A2 | | 22 |
| | | | | | | B3 | A3 | C3 | 23 |
| | | | | | | C1 | B1 | A1 | 24 |
| | | | | | | C2 | B2 | A2 | 25 |
| | | | | | | C3 | B3 | A3 | 26 |
| | | | | | | | C1 | B1 | 27 |
| | | | | | | | C2 | B2 | 28 |
| | | | | | | | C3 | B3 | 29 |
| | | | | | | | A1 | C1 | 30 |
| | | | | | | | | C2 | 31 |

PA=4

PA=1

PA=4

FIG. 10

NONUNIFORM MASK CIRCULATION FOR IRREGULAR PAGE ADVANCE

FIELD OF THE INVENTION

The present invention relates generally to print masking for multi-pass printing, and more particularly to print masking to enable different amounts of page advance after printed passes.

BACKGROUND OF THE INVENTION

Many types of printing systems include one or more printheads that have arrays of marking elements that are controlled to make marks of particular sizes, colors, etc. in particular locations on the print media in order to print the desired image. In some types of printing systems, the array of marking elements extends across the width of the page, and the image can be printed one line at a time. However, the cost of a printhead that includes a page-width array of marking elements is too high for some types of printing applications, so a carriage printing architecture is used.

In a carriage printing system (whether for desktop printers, large area plotters, etc.) the printhead or printheads are mounted on a carriage that is moved past the recording medium in a carriage scan direction as the marking elements are actuated to make a swath of dots. At the end of the swath, the carriage is stopped, printing is temporarily halted and the recording medium is advanced. Then another swath is printed, so that the image is formed swath by swath. In a carriage printer, the marking element arrays are typically disposed along an array direction that is substantially parallel to the media advance direction, and substantially perpendicular to the carriage scan direction. The length of the marking element array determines the maximum swath height that can be used to print an image.

In single-pass printing, each marking element that is used for printing is responsible to print all pixel locations that are required in a corresponding raster line of the image swath. After printing the swath, the page is advanced by a distance corresponding to the length of the marking element array and the next swath is printed, again with each marking element being responsible to print all pixel locations that are required in the corresponding raster line of that image swath. Single pass printing has the advantage of fast print throughput, and is frequently used in draft printing modes. However, in practice, marking elements are nonuniform in a variety of ways. They can produce nonuniform dot sizes on the recording medium. They can be misdirected such that the dot location is displaced from its intended location. They can be defective such that no dot at all is produced. Such nonuniformities produce objectionable image quality defects in single-pass printing.

In multi-pass printing, responsibility for printing each raster line of the image is shared between a plurality of marking elements. In this way the nonuniform marking behavior of marking elements can be disguised in order to provide improved image quality. Multi-pass printing can also enable multi-tone printing in which multiple dots are printed in the same pixel locations, and can also provide time for improving the uniformity of ink-media interactions by controlling the pattern of dots that can be printed within one pass. Multi-pass printing is described in more detail in commonly assigned co-pending U.S. Patent Publication No. 2007/0201054 A1.

In order to ensure that each pixel location of the image can be printed during at least one of the m passes in a multi-pass print mode, a print mask is provided for each color plane of the image. The print mask is typically a two dimensional array of rows and columns of Boolean data. Each row of the print mask contains 1's and 0's for each corresponding marking element in the marking element array indicating which pixel locations are authorized for printing by that marking element during the printing of a swath of data. In other words, the print mask data is ANDed with the image data in order to indicate which pixel locations can be printed by each marking element in a given print swath. For single-tone m-pass printing (where each pixel location can receive one and only one dot during the printing of the m passes), the print mask is composed of m mask sections, where each mask section includes complementary mask data, such that each row of data in one mask section is complementary to corresponding rows in the other mask sections.

In normal multi-pass printing, after each swath of data is printed, the recording medium is advanced by a distance corresponding to the length of the marking element array divided by m. If there are a total of M marking elements in the array that prints the swath, every (M/m)th marking element shares responsibility for printing a given line of the image. Therefore, a set of marking elements separated by the total number of marking elements divided by m is sometimes called a set of complementary marking elements.

It is found that while normal multi-pass printing is effective in disguising print quality defects due to nonuniform marking elements, there can still be banding defects that are observable in the image, such as chromatic banding. Observability of such banding defects can be reduced, if the page is not always advanced by a distance corresponding to the length of the marking element array divided by m, but is rather irregularly advanced. Irregular page advance is disclosed, for example in U.S. Pat. Nos. 6,336,702 and 6,866,358.

The problem with irregularly advancing the page by different amounts is that a single-mask configuration having complementary mask sections no longer has the complementary rows of mask data lining up in successive print passes. As a result, some pixel locations cannot be printed. One way to solve this is to use different print masks for different print passes, but this complicates the printing and also results in excessive memory requirements.

What is needed is a method for compensating for irregular page advances of the recording medium during multi-pass printing.

SUMMARY OF THE INVENTION

The aforementioned need is addressed by the present invention with s method for reducing banding artifacts in a printed image, including irregularly advancing a media that will be printed upon while employing an entire single mask for marking elements of a printhead; and calculating a difference between an irregular advance amount of the media versus a nominal advance amount of the media. Finally, the single mask is nonuniformly circulated by the difference calculated in order to compensate for the media being irregularly advanced.

Another aspect of the invention provides a printing system that includes a printhead comprising an array of marking elements; and a carriage for moving the printhead in a carriage scan direction relative to a recording media. A media advance subsystem advances the recording media. In addition, a printing system controller includes:

1) a look-up table for specifying a sequence of irregular media advance amounts to the media advance subsystem;

2) a memory that stores a single-print mask for specifying which of the marking elements of the printhead can print at a given location;

3) a calculator for calculating a difference between an irregular advance amount of the media versus a nominal advance amount of the media; and 4) a circulator for circulating the single mask by the difference calculated in order to compensate for the media being irregularly advanced.

BRIEF DESCRIPTION OF THE DRAWINGS

FIG. 10 illustrates an embodiment of nonuniform circulation of the rows of a print mask to compensate for irregular page advances in 3-pass printing.

DETAILED DESCRIPTION OF THE INVENTION

Figure 1:
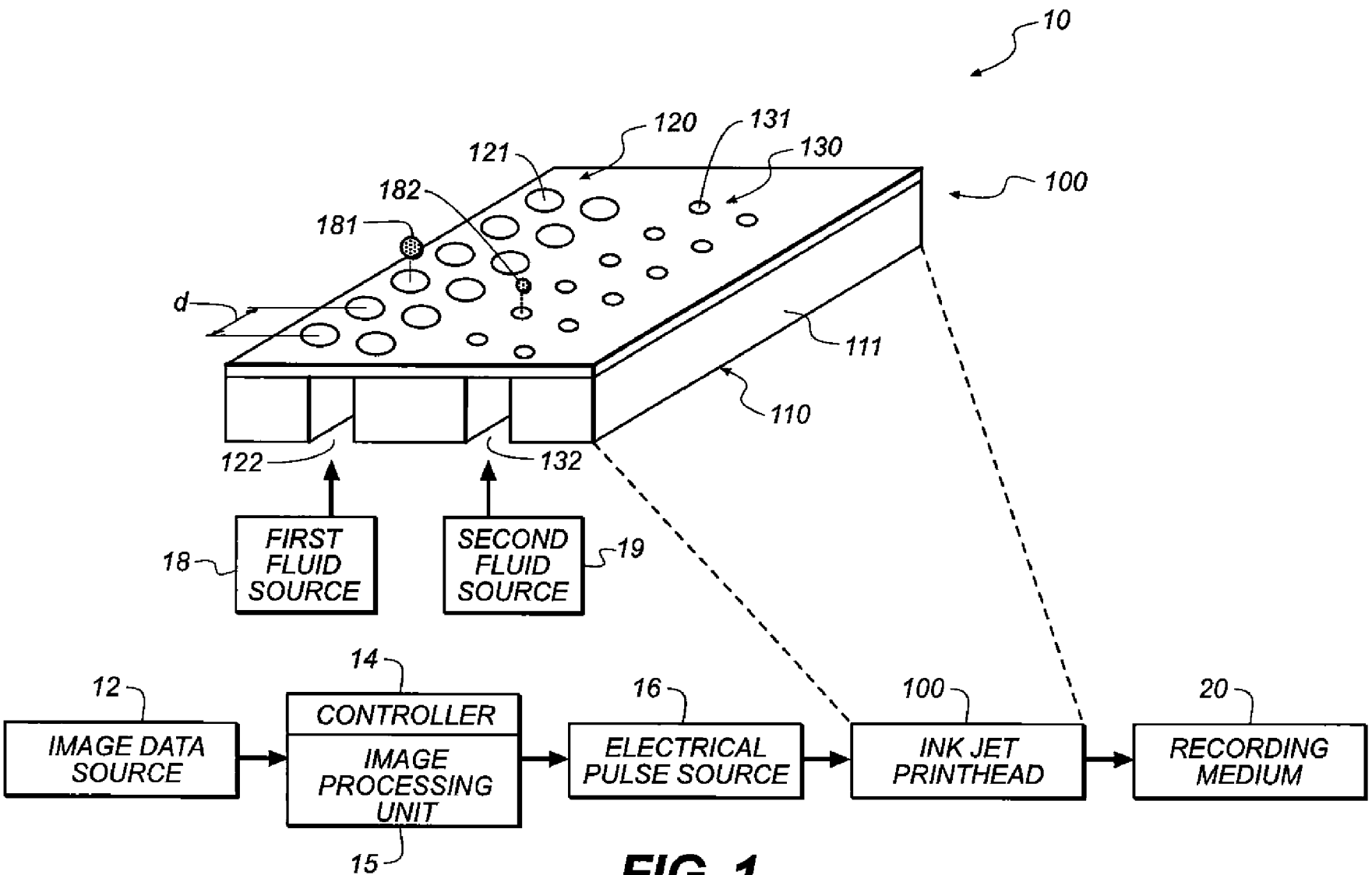
FIG. 1 is a schematic representation of an inkjet printer system.

Referring to FIG. 1, a schematic representation of an inkjet printer system 10 is shown. Printer system 10 includes a source 12 of image data, which provides data signals that are interpreted by a controller 14 as being commands to eject drops. Controller 14 includes an image processing unit 15 for rendering images for printing, and outputs signals to a source 16 of electrical energy pulses that are inputted to an inkjet printhead 100, which includes at least one printhead die 110.

In the example shown in FIG. 1, there are two nozzle arrays. Nozzles 121 in the first nozzle array 120, having a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch. If pixels on the recording medium were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with nozzle array 120, and ink delivery pathway 132 is in fluid communication with nozzle array 130. Portions of fluid delivery pathways 122 and 132 are shown in FIG. 1 as openings through printhead die substrate 111. One or more printhead die 110 will be included in inkjet printhead 100, but only one printhead die 110 is shown in FIG. 1. The printhead die are arranged on a support member as discussed below relative to FIG. 2. In FIG. 1, first ink source 18 supplies ink to first nozzle array 120 via ink delivery pathway 122, and second ink source 19 supplies ink to second nozzle array 130 via ink delivery pathway 132. Although distinct ink sources 18 and 19 are shown, in some applications, it may be beneficial to have a single ink source supplying ink to nozzle arrays 120 and 130 via ink delivery pathways 122 and 132 respectively. Also, in some embodiments, fewer than two or more than two nozzle arrays may be included on printhead die 110. In some embodiments, all nozzles on a printhead die 110 may be the same size, rather than having multiple sized nozzles on a printhead die.

Not shown in FIG. 1, are the drop-forming mechanisms associated with the nozzles. Drop-forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bilayer element) and thereby cause ejection. In any case, electrical pulses from pulse source 16 are sent to the various drop ejectors according to the desired deposition pattern. In the example of FIG. 1, droplets 181 ejected from nozzle array 120 are larger than droplets 182 ejected from nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
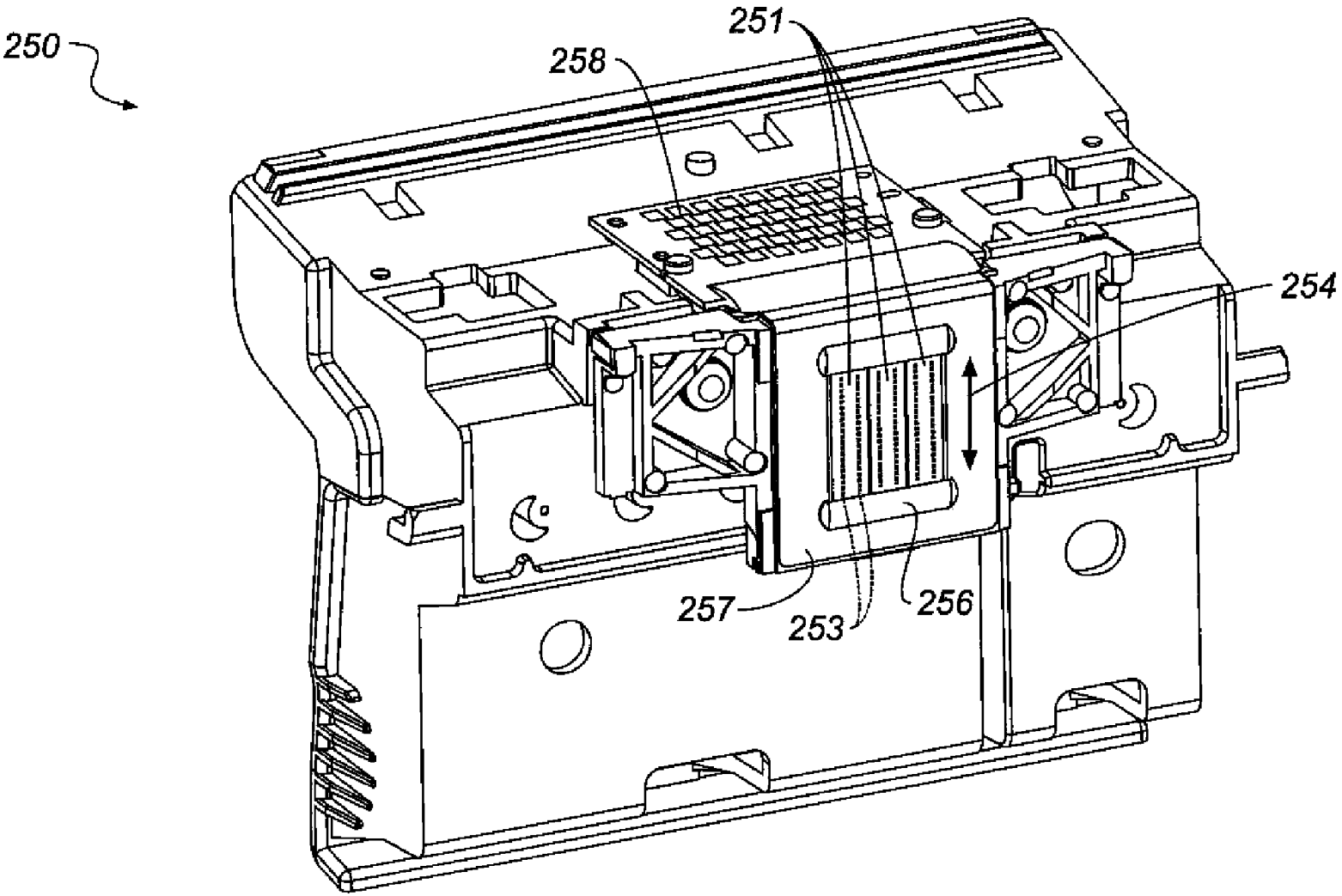
FIG. 2 is a perspective view of a portion of a printhead chassis.

FIG. 2 shows a perspective view of a portion of a printhead chassis 250, which is an example of an inkjet printhead 100. Printhead chassis 250 includes three printhead die 251 (similar to printhead die 110), each printhead die containing two nozzle arrays 253, so that printhead chassis 250 contains six nozzle arrays 253 altogether. The six nozzle arrays 253 in this example may be each connected to separate ink sources (not shown in FIG. 2), such as cyan, magenta, yellow, text black, photo black, and a colorless protective printing fluid. Each of the six nozzle arrays 253 is disposed along direction 254, and the length of each nozzle array along direction 254 is typically on the order of 1 inch or less. Typical lengths of recording media are 6 inches for photographic prints (4 inches by 6 inches), or 11 inches for 8.5 by 11 inch paper. Thus, in order to print the full image, a number of swaths are successively printed while moving printhead chassis 250 across the recording medium or media (notably, the term "media" is used interchangeably with "recording medium" herein). Following the printing of a swath, the recording medium is advanced along a media advance direction 304 that is substantially parallel to nozzle array direction 254.

Also shown in FIG. 2 is a flex circuit 257 to which the printhead die 251 are electrically interconnected, for example by wire bonding or TAB bonding. The interconnections are covered by an encapsulant 256 to protect them. Flex circuit 257 bends around the side of printhead chassis 250 and connects to connector board 258. When printhead chassis 250 is mounted into the carriage 200 (see FIG. 3), connector board 258 is electrically connected to a connector (not shown) on the carriage 200, so that electrical signals may be transmitted to the printhead die 251.

Figure 3:
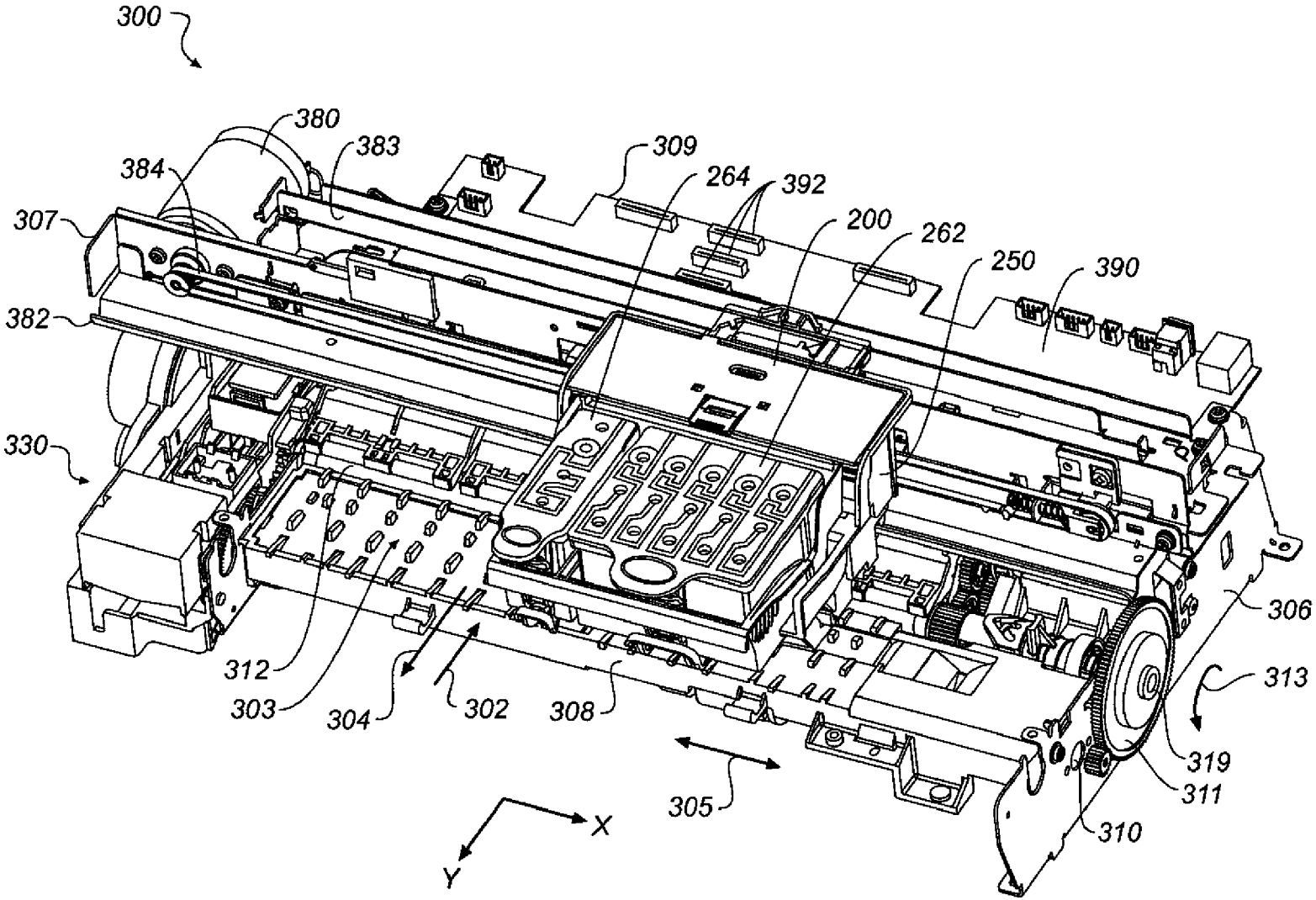
FIG. 3 is a perspective view of a portion of a carriage printer.

FIG. 3 shows a portion of a desktop carriage printer. Some of the parts of the printer have been hidden in the view shown in FIG. 3 so that other parts may be more clearly seen. Printer chassis 300 has a print region 303 across which carriage 200 is moved back and forth in carriage scan direction 305 along the X axis, between the right side 306 and the left side 307 of printer chassis 300, while drops are ejected from printhead die 251 on printhead chassis 250 that is mounted on carriage 250. Carriage motor 380 moves belt 384 to move carriage 200 along carriage guide rail 382. An encoder sensor (not shown) is mounted on carriage 200 and indicates carriage location relative to an encoder fence 383.

Printhead chassis 250 is mounted in carriage 200, and ink supplies 262 and 264 are mounted in the printhead chassis 250. The mounting orientation of printhead chassis 250 is rotated relative to the view in FIG. 2, so that the printhead die 251 are located at the bottom side of printhead chassis 250, the droplets of ink being ejected downward onto the recording media in print region 303 in the view of FIG. 3. Ink supply 262, in this example, contains five ink sources cyan, magenta, yellow, photo black, and colorless protective fluid, while ink supply 264 contains the ink source for text black. Paper or other recording media (sometimes interchangeably referred to as paper or media herein) is loaded along paper load entry direction 302 toward the front 308 of printer chassis 300.

Figure 4:
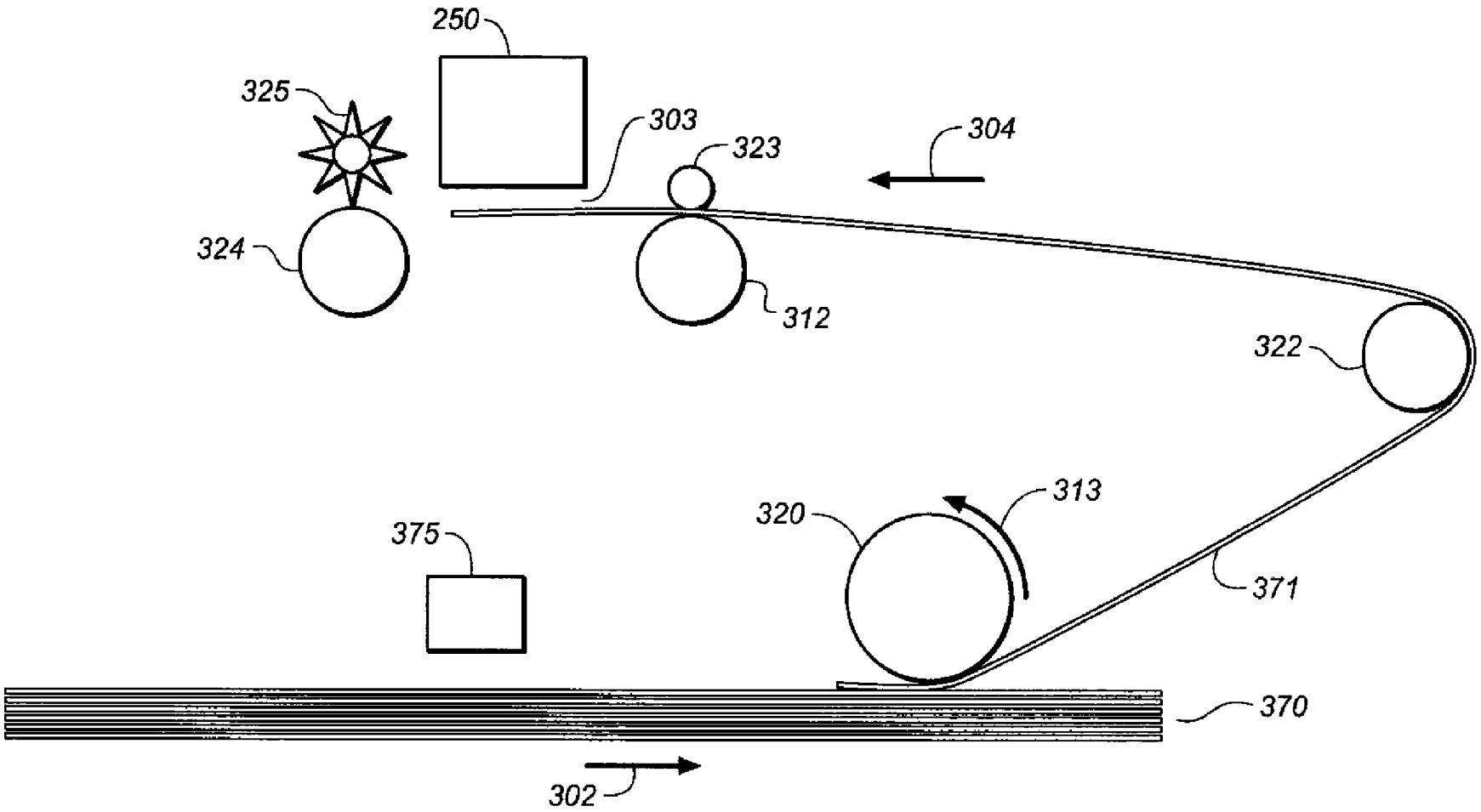
FIG. 4 is a schematic side view of a paper path in a carriage printer.

A variety of rollers are used to advance the medium through the printer, as shown schematically in the side view of FIG. 4. In this example, a pickup roller 320 moves the top sheet 371 of a stack 370 of paper or other recording media in the direction of arrow 302. A turn roller 322 acts to move the paper around a C-shaped path (in cooperation with a curved rear wall surface) so that the paper continues to advance along media advance direction 304 from the rear 309 of the printer (with reference also to FIG. 3). The paper is then moved by feed roller 312 and idler roller(s) 323 to advance along the Y-axis across print region 303, and from there to a discharge roller 324 and star wheel(s) 325 so that printed paper exits along media advance direction 304. Feed roller 312 includes a feed roller shaft along its axis, and feed roller gear 311 is mounted on the feed roller shaft. Feed roller 312 may consist of a separate roller mounted on the feed roller shaft, or may consist of a thin high friction coating on the feed roller shaft.

The motor that powers the paper advance rollers is not shown in FIG. 3, but the hole 310 at the right side 306 of the printer chassis 300 is where the motor gear (not shown) protrudes through in order to engage feed roller gear 311, as well as the gear for the discharge roller (not shown). For normal paper pick-up and feeding, it is desired that all rollers rotate in forward direction 313. Toward the left side 307 in the example of FIG. 3 is the maintenance station 330. Toward the rear 309 of the printer in this example is located the electronics board 390, which contains cable connectors 392 for communicating via cables (not shown) to the printhead carriage 200 and from there to the printhead. Also on the electronics board are typically mounted motor controllers for the carriage motor 380 and for the paper advance motor, a processor and/or other control electronics (shown schematically as controller 14 and image processing unit 15 in FIG. 1) for controlling the printing process, and an optional connector for a cable to a host computer.

Figure 5:
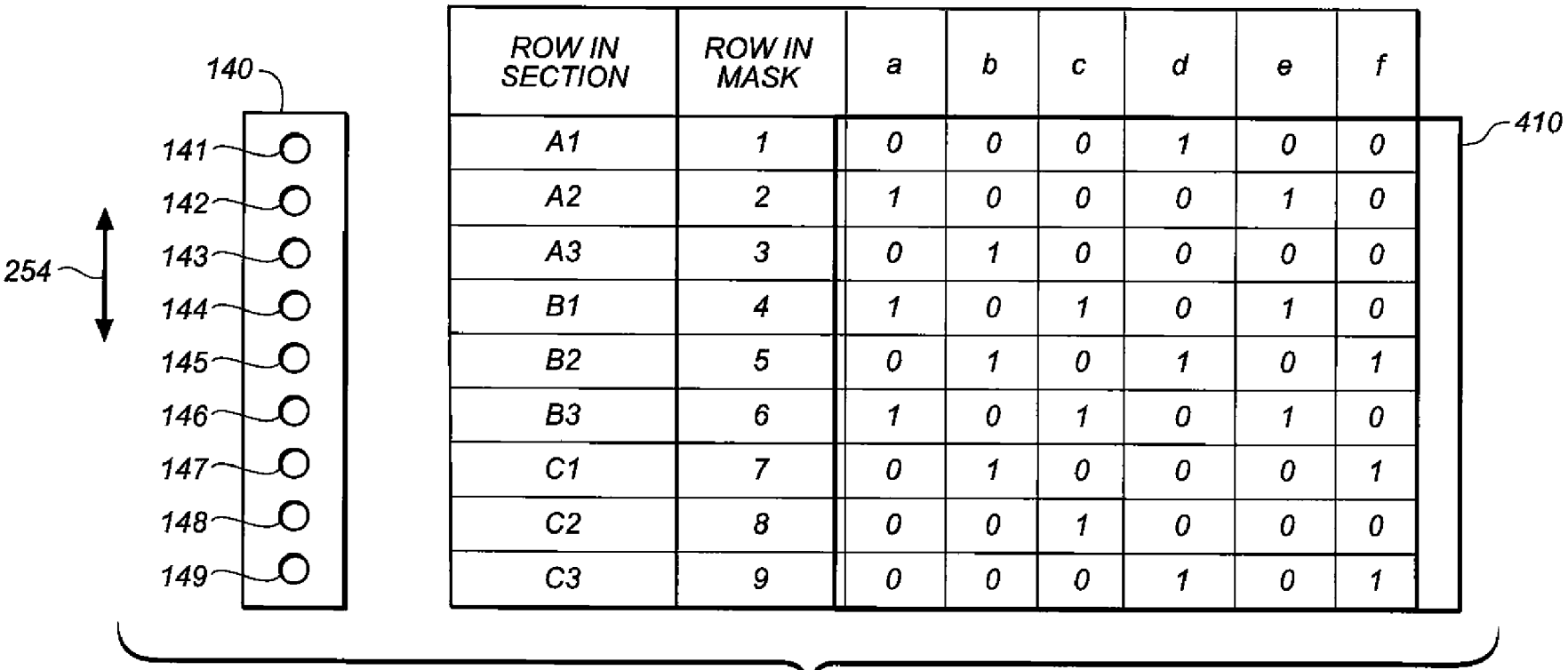
FIG. 5 schematically shows a marking element array and a corresponding print mask for multi-pass printing.

FIG. 5 schematically shows a marking element array 140 having nine marking elements 141-149 arrayed along array direction 254. Marking elements 141-149 can be, for example, inkjet nozzles on an inkjet printhead. Adjacent to marking element array 140 in FIG. 5 is print mask 410 having nine rows corresponding to the nine marking elements of marking element array 140. Print mask 410 consists of six columns (a, b, c, d, e, and f) of nine rows of 1's and 0's. In this example, the 1's indicate permission for a marking element to print a pixel in a particular location, if the image data also indicates that a pixel should be printed in that location. Of course, an image is generally much larger than nine rows by six columns of pixels, so the mask is repeated in tiling fashion both horizontally and vertically. With reference to FIG. 1, print mask 410 is stored in memory in printer controller 14 and works in association with image processing unit 15.

In the example shown in FIG. 5, print mask 410 is designed to accommodate three-pass printing, so its nine rows are divided into three sections A, B, and C, each having three rows. In normal three-pass printing, the marking element array 140 is moved along carriage scan direction 305 and the marking elements print dots on recording medium 20 at positions indicated by printer controller 14 based on image data source 12, image processing unit 15, print mask 410, and carriage location given with reference to encoder fence 383. At the end of a swath of printing, the carriage 250 is stopped, the recording medium 20 is advanced by one third of the marking element array height (i.e., so that in the present example marking element 141 is aligned at the same line of the image that marking element 144 was in during the previous printing swath), and the next swath of the image is printed. Marking elements 141, 144, and 147 are called complementary marking elements, because in successive swaths they are successively aligned to print the same line of the image, therefore, they share the printing responsibility for that line. In order to print all pixel locations, the mask rows controlling the printing of marking elements 141, 144, and 147 (i.e. mask rows A1, B1, and C1 respectively) are required to have a complementary arrangement of 1's and 0's. In other words, for single-tone printing, in each column of print mask 410, there needs to be exactly one 1 in the combination of rows A1, B1, and C1. In column a for example, the one 1 is in row B1. Similarly the mask rows A2, B2, and C2 are complementary and correspond to complementary marking elements 142, 145 and 148. Also mask rows A3, B3, and C3 are complementary and correspond to complementary marking elements 143, 146, and 149.

Figure 6B:
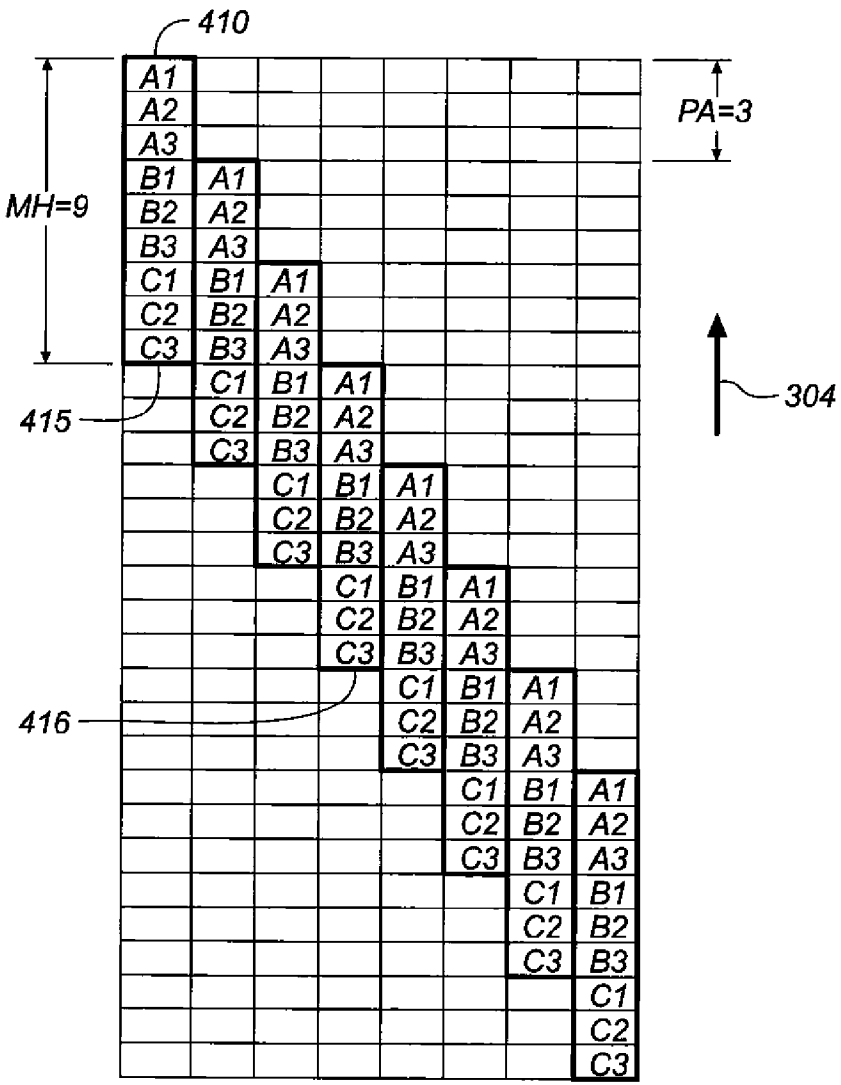
FIG. 6B illustrates the positions on the recording medium that are controlled by different rows of a print mask during normal 3-pass printing.
Figure 6A:
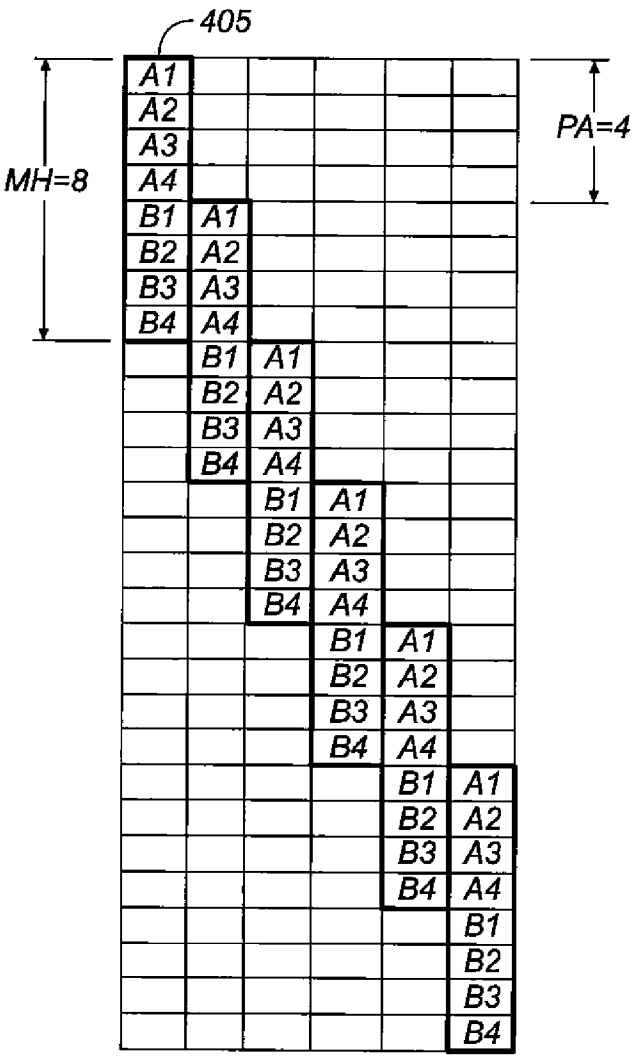
FIG. 6A illustrates the positions on the recording medium that are controlled by different rows of a print mask during 2-pass printing.

FIGS. 6A and 6B show graphical representations of print masks for normal two-pass printing and three-pass printing respectively in relation to different positions relative to their control of printing of different lines of the recording medium as the recording medium is advanced along media advance direction 304. FIG. 6B corresponds to a three-pass nine-row print mask 410 of the type described above with reference to FIG. 5 (mask height MH=9 rows). As the recording medium is advanced relative to the printhead (for example, marking element array 140) in equal page advance increments PA=3 effective marking element spacings, the various rows print mask 410 are applied to control printing on different lines of image onto the recording medium. As can be seen in FIG. 6B, the complementary rows of the print mask are aligned along particular lines of the recording medium at each pass for normal three pass printing where the page advance distance is one third of the length of the marking element array. This means that each pixel position is printable by one of the complementary marking elements. Also, after three page advances of one third of the length of the marking element array, the marking element array is positioned such that the marking element at one end of the array is positioned at the pixel line that is adjacent to the pixel line that the marking element at the opposite end of the array had been positioned at three passes previously. Correspondingly, in FIG. 6B, mask row Al at mask control position at 416 is shown to be adjacent to the position of mask row C3 at mask control position 415 three passes previously.

FIG. 6A is similar to FIG. 6B, but shows the example of normal two-pass printing using an eight row print mask 405 corresponding to a marking element array having eight marking elements (not shown). In the example of FIG. 6A, the page advance is PA=4 marking element spacings, and the complementary pairs of mask rows are A1 and B1; A2 and B2; A3 and B3; and A4 and B4. In general, in the notation of FIGS. 6A and 6B, the complementary mask rows are the ones where the numerals (1, 2, or 3) following the mask section designator (A, B, or C) are the same. Incidentally, the number of marking elements referred to here, is the number that are actually used for printing. The same physical printhead may be used in the examples of FIGS. 6A and 6B, but nine marking elements would be used for the example of FIG. 6B, while only eight would be used for the example of FIG. 6A. Furthermore, even though only eight of the nine marking elements are used in the example of FIG. 6A, printing throughput is actually faster than for the example of FIG. 6B. Because the page advance distance is 4 in FIG. 6A, but only 3 in FIG. 6B, it would take more printing passes to print the entire image for the three-pass printing. Generally, higher numbers of passes provide better image quality, but that must be traded off against printing throughput. Different print modes are provided to the user for different image quality/throughput trade-offs.

Generalizing from the examples discussed above, for normal m-pass printing, the print mask has m mask sections. If the corresponding marking element array has M marking elements that are used in printing the image, the amount of page advance after each printing swath is given by PA=M/m marking element spacings. For a print mask having a corresponding number of rows M, the number of rows in each of the m mask sections is also M/m. After m passes, one end row of the mask controls printing for a line of the image that is adjacent to a line of the image that the opposite end of the mask controlled m passes previously.

Although multi-pass printing is very beneficial in hiding print quality defects due to marking element defects, for example, normal multi-pass printing where the page advance is always the same distance PA=M/m can still be associated with banding defects in the image, such as chromatic banding. It has been found that irregular page advances, where not all page advances are the same distance PA=M/m is effective in hiding banding defects such as chromatic banding.

The problem is that if irregular page advances are used, the complementary rows of the mask no longer are aligned in subsequent passes, so that some pixel locations will have no 1 from any mask section so that they cannot be printed, while other mask locations will have multiple 1's and will be printed multiple times. A brute-force way to solve this problem for m-pass printing would be to provide m different masks. FIG. 7A shows an example of two masks 420 and 421 used for two pass printing where the number of mask rows is M=8, the first page advance distance is PA=2 and the second page advance distance is 6, and subsequent page advance distances continue to cycle 2, 6, 2, 6, etc. Thus after every m=2 passes, one end row of mask 420 controls printing for a line of the image that is adjacent to a line of the image that the opposite end of mask 420 controlled m=2 passes previously, as shown in mask positions 422 and 423. Masks 420 and 421 are used on alternate printing passes and are designed such that the complementary portions are those mask rows that control printing for the same row of pixels In other words, in this example, it is no longer required that rows A1 and B1 of mask 420 be complementary to each other. Rather, it is required that row A1 of mask 420 be complementary to row D3 of mask 421. Other mask row pairs in masks 420 and 421 that need to be complementary to each other include A2 and D4; A3 and C1; A4 and C2; B1 and C3; B2 and C4; B3 and D1, and B4 and D2. For the corresponding marking element array (not shown), in the odd numbered passes, row A1 of mask 420 controls the printing of marking element 1, while in the even numbered passes, row C1 of mask 421 controls the printing of marking element 1.

Figure 7B:
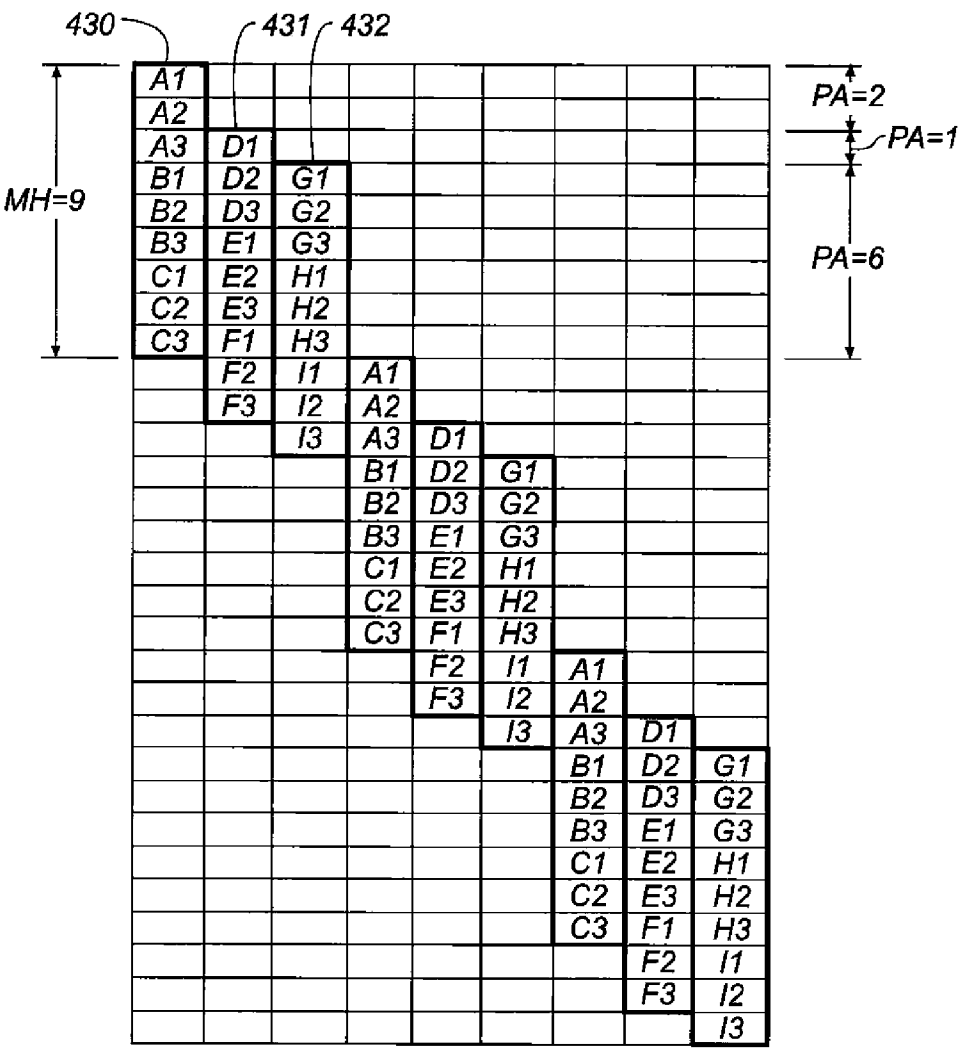
FIGS. 7A and 7B illustrate the use of multiple masks to control 2-pass and 3-pass printing respectively for irregular page advances.
Figure 7A:
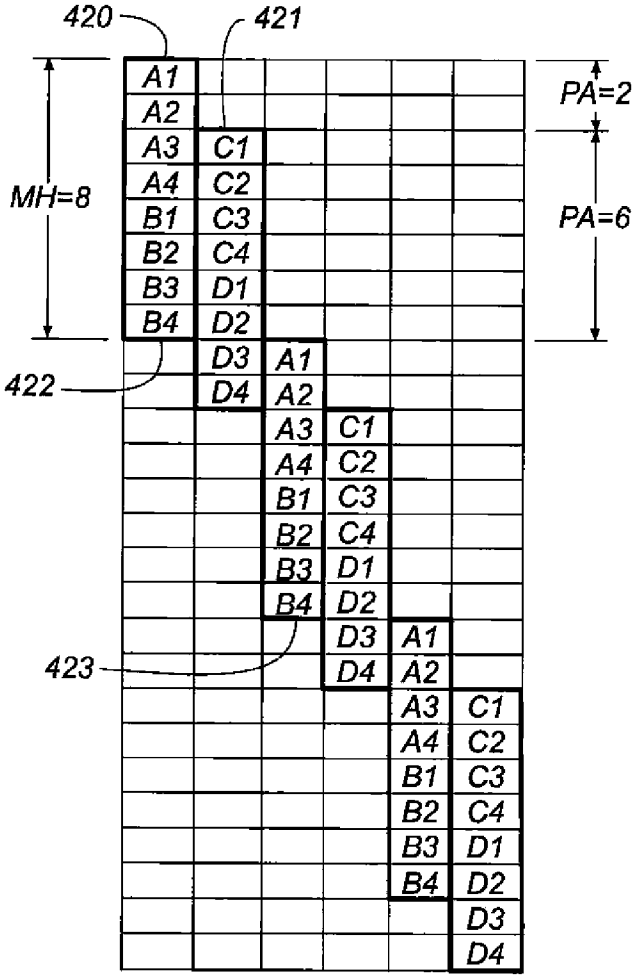

FIG. 7B is similar to FIG. 7A, but for irregular page advances for three-pass printing. Masks 430, 431, and 432 each have M=9 rows. The first page advance is PA=2, the second page advance is PA=1, and the third page advance is PA=6. Subsequent page advances continue to cycle 2, 1, 6, 2, 1, 6, etc. Thus, just as in the example of FIG. 7A, the sum of m successive page advances equals M, the number of rows in the mask (or the number of marking elements in the array). On the first pass, mask row A1 of mask 430 controls marking element 1, while on the second pass, mask row D1 of mask 431 controls marking element 1, and on the third pass, mask row G1 of mask 432 controls marking element 1.

Although the method of print masking for irregular page advances represented by FIGS. 7A and 7B would work, the method would be complicated to implement and would also take up additional memory space in controller 14, since there would be m print masks to store corresponding to each marking element array (each mask plane) rather than just one. In a printhead, such as the one illustrated in FIG. 2, there are six marking element arrays and each marking element array has 640 marking elements. Thus, a typical mask might have 640 rows, and also might have 32 columns, for example. In addition, different print modes for different printing qualities or different printing media require different numbers of passes. There may be a two-pass print mode for a fast printing mode, a four-pass print mode for a higher quality print mode, and a five-pass print mode for an even higher quality print mode. Thus, the number of different print masks required to be stored in this simple example would be 6×(2+4+5)=66. It would be much preferable to only require storage of one print mask for each print mode and each mask plane (i.e. 6×3=18 in this example).

Embodiments of the present invention solve this problem by nonuniform circulation of the rows of mask data in a single original mask by an amount that compensates for the difference between normal page advance distances and irregular page advance distances. This enables requiring storage of only one mask for each mask plane for each print mode.

The terminology "nonuniform circulation" of the print mask is used herein to represent the rearrangement of rows of the mask in a circular rotational sense, in which rows move up or down in the mask (and rows at the top or bottom of the mask move to the opposite end of the mask depending on the direction of circulation). The amount of circulation of the rows is nonuniform throughout the various passes of an m-pass printing mode in order to compensate for irregular page advance distances, but after m passes the mask rows have fully circulated back into their positions in the original mask.

Nonuniform circulation is also used herein in order to distinguish from the use of the terminology "mask rotation" that is used in U.S. Pat. No. 5,555,006 to describe different processes from those described in present invention. In the background section of '006, the term "space rotation" is used to describe how to build a print mask having a top half and a bottom half that are complementary to each other, but the same configuration of the mask is used during each printing pass. Also in the background section of '006, the term "sweep rotation" is used to describe using a single mask that does not have complementary sections but adjacent complementary rows. After a first pass is printed, the mask is rotated by one row to form the mask complement to use in a second pass. Sweep rotation as described in the background section of '006 works for very uniform masks, but would not work for masks such as the one depicted in FIG. 5 where the mask has a nonuniform density of 1's in different mask sections. Sweep rotation of a mask is also disclosed in the description of the embodiments of '006 for use while printing at the top or bottom edge of a sheet. For these regions '006 discloses printing multiple successive passes without advancing the sheet, but sweep rotating the mask to enable the same jet to print the entire line of pixels. Again, this is different from nonuniform circulation of a mask to compensate for irregular page advance as described in the present invention. Further, in the background section of '006, "autorotation" is used to describe the construction of a mask consisting of a periodic arrangement of rows in which the amount of uniform page advance is a non-integral multiple of the mask periodicity. The same mask configuration is used in each pass in autorotation as disclosed in '006, and this is different from the nonuniform circulation to compensate for irregular page advance described herein. Finally, in the description of embodiments of '006 the term "rotation sequence" is used in connection with a masking method in which the example includes three masks used in the three passes. The three masks of the example cannot be derived from each other by a rearrangement of mask rows, but rather by a rotation of mask columns. Such a column rearrangement is not useful for compensating for irregular page advances, in contrast to embodiments of the present invention where the rows of the mask are nonuniformly circulated in order to compensate for irregular page advances.

Figure 8B:
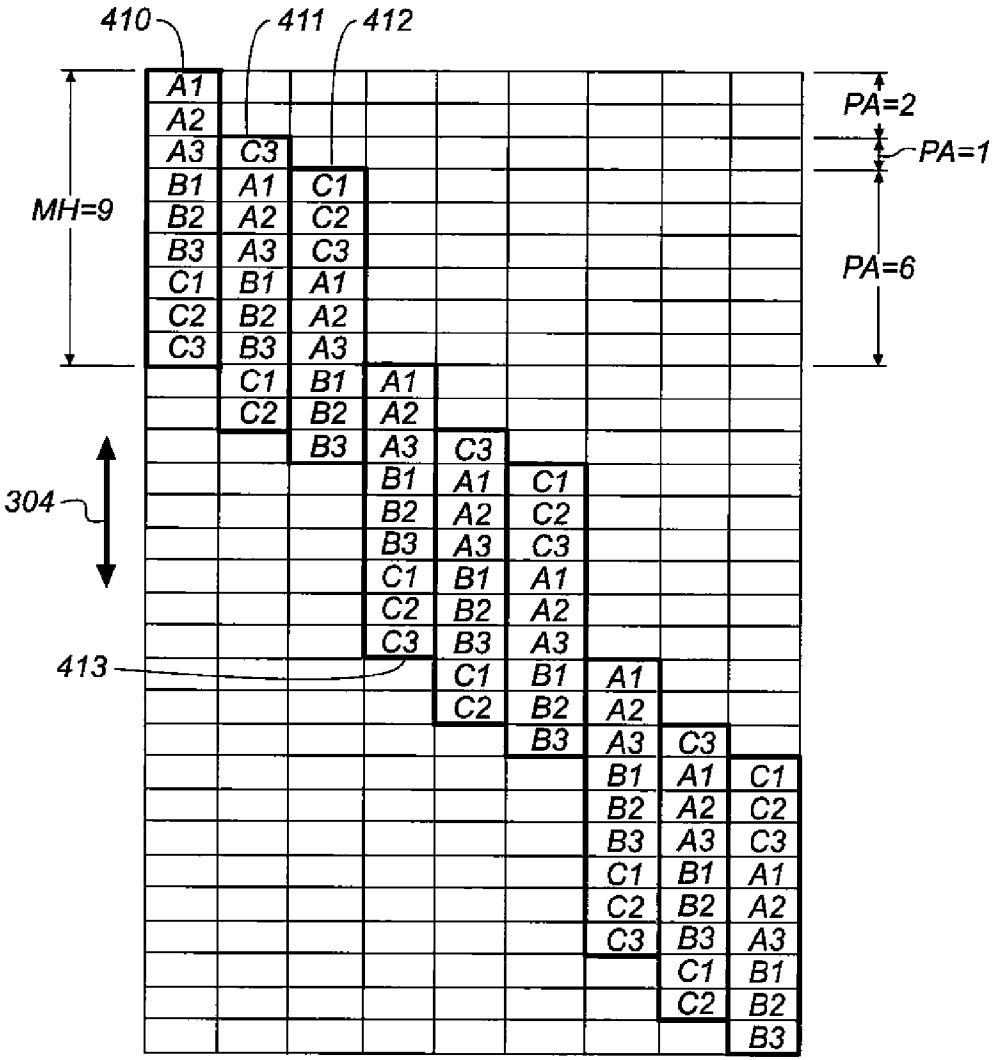
FIG. 8B illustrates an embodiment of nonuniform circulation of the rows of a print mask to compensate for irregular page advances in 3-pass printing.
Figure 8A:
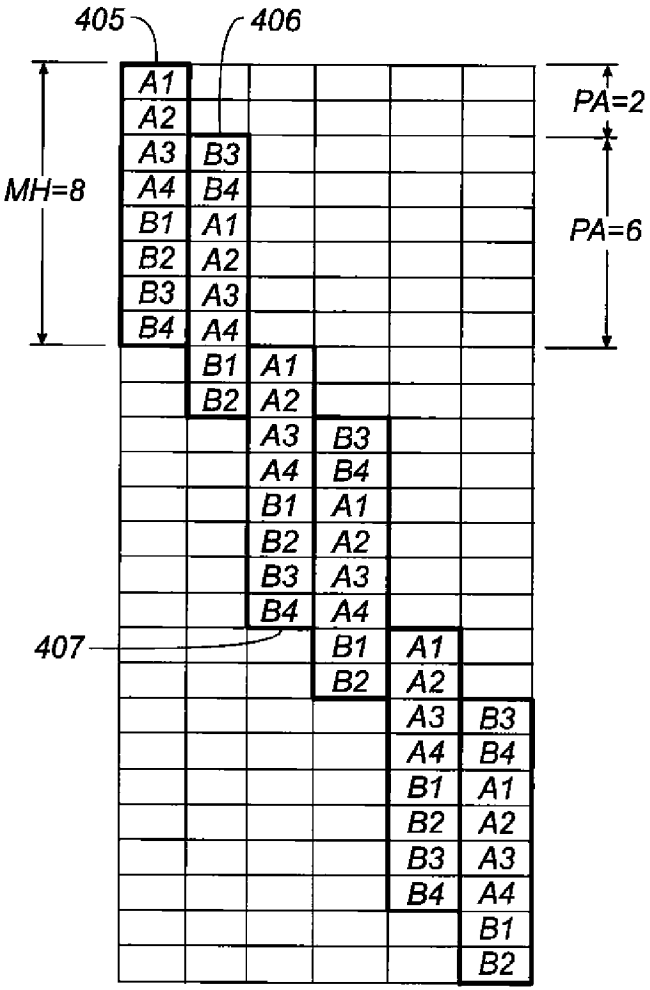
FIG. 8A illustrates an embodiment of nonuniform circulation of the rows of a print mask to compensate for irregular page advances in 2-pass printing.

FIGS. 8A and 8B show exemplary embodiments of nonuniform mask circulation to accommodate irregular page advances for 2-pass printing for a marking element array having eight marking elements, and 3-pass printing for a marking element array having nine marking elements respectively. Even though the irregular page advances (PA=2 and PA=6) are the same as they were in the example shown in FIG. 7A respectively that required two masks 420 and 421, in the nonuniform mask circulation embodiment shown in FIG. 8A, only a single two-pass mask 405 is needed. The mask rows of print mask 405 are incrementally circulated to provide circulated mask 406 in order to compensate for the irregular page advance of PA=2 rather than a page advance PA=4 for the normal page advance distance for two-pass printing with eight marking elements. After the second irregular page advance of PA=6, the two-pass mask has been fully circulated back into its original configuration 405 at position 407 for the third pass. Note that the effect of circulating the mask rows is to bring complementary mask rows into alignment. To accomplish the circulation from original configuration 405 to circulated mask 406, rows A1, A2, A3, A4, B1, and B2 are each moved down by two mask rows, while B3 and B4 move from the bottom of the mask to the first and second rows respectively in circulated mask 406. In odd numbered print passes, mask row A1 controls the printing of marking element 1, while in even numbered print passes; complementary mask row B1 controls the printing of marking element 1. Correspondingly, in odd numbered print passes, mask row B1 controls the printing of marking element 5, while in even numbered print passes; complementary mask row A1 controls the printing of marking element 5.

FIG. 8B illustrates nonuniform mask circulation for irregular page advances for three-pass printing. Even though the irregular page advances (PA=2, PA=1, and PA=6) are the same as they were in the example shown in FIG. 7B respectively that required three different masks 430, 431, and 432, in the nonuniform mask circulation embodiment shown in FIG. 8B, only a single three-pass mask 410 is needed. The mask rows of print mask 410 are incrementally circulated first to provide circulated mask 411 to be used in the second pass of printing in order to compensate for the irregular page advance of PA=2 rather than a page advance PA=3 for the normal page advance distance for three-pass printing with nine marking elements. The mask rows are further incrementally circulated to provide circulated mask 412 to be used in the third pass of printing in order to compensate for the irregular page advance of PA=1. After the third irregular page advance of PA=6, the two-pass mask has been fully circulated back into its original configuration 410 at position 413 for the fourth pass. Note again in this example that the effect of nonuniformly circulating the mask rows is to bring complementary mask rows into alignment. To accomplish the circulation from original configuration 410 to circulated mask 411, rows A1, A2, A3, B1, B2, B3, C1, and C2 are each moved down by one mask row, while row C3 moves from the bottom of the mask to the first row in circulated mask 411. Relative to circulated mask 411, in order to provide circulated mask 412, rows C3, A1, A2, A3, B1, B2, and B3 are each moved down by one mask row, while rows C1 and C2 move from the bottom of mask 411 to the first two rows in circulated mask 412. To complete the circulation from circulated mask 412 back to original mask configuration 410 at position 413, the mask rows of 412 are moved down by six rows, or equivalently, they are moved up by three rows.

A more general to describe the method of nonuniform print mask circulation in order to compensate for page advance distances that are not equal to the normal equally spaced page advance distance is given as follows. If the printhead includes an array of M marking elements, where the marking elements are spaced apart by an effective distance d, and if a print mask $P_0$ is provided with a total of M rows and m mask sections, then the normal equally-spaced page advance distance is D=Md/m for m-pass printing. If, instead of the normal equally-spaced page advance, the recording medium is advanced along the media advance direction by a distance $D_1=(M/m+n_1)d$ after printing the first swath $S_0$, where $n_1$ is an integer, then the mask entries should be incrementally circulated by an amount $n_1$ rows in order to provide a circulated print mask $P_1$. The next swath $S_1$, which partially overlaps swath $S_0$, is then printed using the circulated print mask $P_1$. If the next media advance distance after printing swath $S_1$ is $D_2=(M/m+n_2)d$, where $n_2$ is an integer, then relative to mask $P_1$, the mask entries should be circulated by an amount $n_2$ rows to provide a circulated print mask $P_2$. This is equivalent to circulating the mask entries in the original mask $P_0$ by an amount $(n_1+n_2)$ rows. The next swath $S_2$, which partially overlaps swath $S_1$ (and also partially overlaps swath $S_0$ if m>2), is then printed using the circulated print mask $P_2$. If the next media advance distance after printing swath $S_2$ is $D_3=(M/m+n_3)d$, where $n_3$ is an integer, then relative to mask $P_2$, the mask entries should be circulated by an amount $n_3$ rows to provide a circulated print mask $P_3$. This is equivalent to circulating the mask entries in the original mask $P_0$ by an amount $(n_1+n_2+n_3)$ rows. The next swath $S_3$, which partially overlaps swath $S_2$ (and also partially overlaps swath $S_0$ if m>3), is then printed using the circulated print mask $P_3$. After these steps have been iteratively continued m times, the mask $P_m$ is the same as $P_0$, i.e., the successive incremental have fully circulated the mask back into its original configuration. Another way to say this is that the sum $$(n_1+n_2+\ldots+n_m)=0 \quad \text{(Equation 1)}$$

For normal multi-pass printing, each value of $n_i=0$. For irregular page advance printing, at least two values of $n_i$ are not equal to zero. By definition of irregular page advance printing, at least one value of $n_i$ is not equal to zero. Then for equation 1 to be true, there must be at least one other value of $n_i$ that is not equal to zero.

To illustrate the above description of print mask circulation in order to make complementary mask rows be aligned in subsequent print passes to compensate for irregular page advances, consider again the three-pass printing embodiment with reference to FIG. 8B. After printing the first swath So with mask $P_0$ (mask 410 having M=9 rows and m=3 sections), the recording medium is advanced by PA=2; i.e., a distance $D_1=2d=(3-1)d$, so that $n_1=-1$. As a result, the mask entries of mask $P_0$ (410) need to be moved down (i.e., a negative incremental circulation that is in an opposite direction to media advance direction 304 because $n_i$ is negative) by 1 row in order to provide incrementally circulated mask $P_1$ (411). Then after printing swath $S_1$, the recording medium is advanced by PA=1, i.e. a distance $D_2=d=(3-2)d$, so that $n_2=-2$. As a result, the mask entries of circulated mask $P_1$ (411) need to be moved down by 2 rows in order to provide circulated mask $P_2$ (412). Equivalently it can be said that circulated mask $P_2$ (412) is the result of circulating original mask $P_0$ (410) by $n_1+n_2=-3$ rows. Then after printing swath $S_2$, the recording medium is advanced by PA=6, i.e., a distance $D_3=6d=(3+3)d$, so that $n_3=+3$. As a result, the mask entries of circulated mask $P_2$ (412) need to be moved up (i.e., a positive incremental circulation that is in the same direction as media advance direction 304 because $n_3$ is positive) by 3 rows. The resulting fully circulated mask at position 413 for printing swath $S_3$ is the same as original mask $P_0$ (410) because m=3, and $n_1+n_2+n_3=0$.

Figure 9:
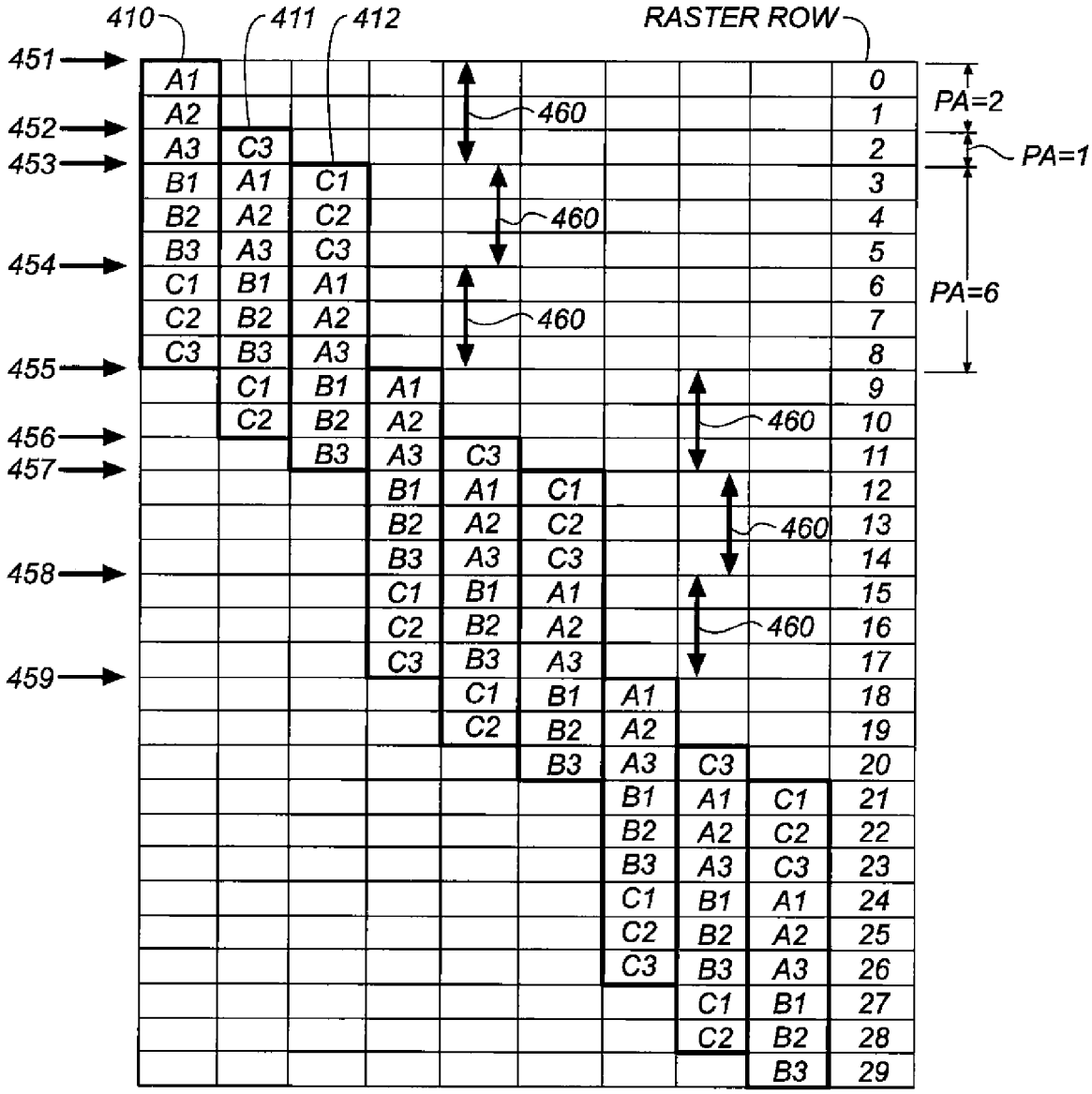
FIG. 9 illustrates an embodiment of nonuniform circulation of the rows of a print mask to compensate for irregular page advances in 3-pass printing.

An alternative but equivalent way of describing nonuniform mask circulation in order to make complementary mask rows be aligned in subsequent print passes to compensate for irregular page advances is next given with reference to FIG. 9. FIG. 9 represents three pass printing for a printhead with a marking element array having nine marking elements, where the page advances are PA=2, then 1, and then 6, just as in FIG. 8B. Arrow 451 represents the position of the "top" of mask 410 (i.e., at raster row 0) during the printing of swath $S_0$ in pass 1. Arrow 452 indicates the actual position of the top of circulated mask 411 (i.e., at raster row 2) during the printing of swath $S_1$ in pass 2 after a page advance of PA=2. By comparison, double ended arrows 460 represent the amount of page advance (PA=3) that would occur for normal three pass printing with an array having nine marking elements. Thus the normal mask position for pass 2 is shown by arrow 453 (i.e., at raster row 3). The mask offset is defined as the normal mask position minus the actual mask position (i.e. the mask offset is 3−2=1 in this example). After printing swath $S_1$ in pass 2 the recording medium is advanced by PA=1, so that the actual position of the top of mask 412 is at raster row 3 for pass 3 (i.e., the sum of the first two page advances), which is also denoted by arrow 453. The normal mask position for pass 3 is shown by arrow 454 (i.e., at raster row 2×3=6). Thus the mask offset at this point is 6−3=3. After printing swath $S_2$ in pass 3 the recording medium is advanced by PA=6, so that the actual position of the top of the mask is at raster row 9 for pass 4 (i.e., the sum of the first three page advances), which is denoted by arrow 455. The normal mask position for pass 4 is shown by arrow 455 (i.e., at raster row 3×3=9). The mask offset at this point is 9−9=0. After printing swath S3 in pass 4, the recording medium is again advanced by PA=2, so that the actual position of the top of the mask is at raster row 11 for pass 5 (i.e., the sum of the first four page advances), which is denoted by arrow 456. The normal mask position for pass 5 is shown by arrow 457 (i.e. at raster row 4×3=12). The mask offset at this point is 12×11=1 just as it was at pass 2. Similarly for pass 6, the normal mask position is shown by arrow 458 at raster row 15, but the actual position after the page advance of PA=1 is at raster row 12 for a mask offset of 3. Similarly for pass 7, the normal mask position is shown by arrow 458 at raster row 18, which is the same as the actual position after the page advance of PA=6, so that the mask offset is again 0. In this description of irregular page advances, the amount of mask circulation relative to the original mask 410 is the same as the mask offset. If the mask offset is positive, the rows are circulated downward. If the mask offset is negative, the rows are circulated upward. Thus mask entries in mask 411 are circulated downward by 1 row relative to mask 410, because the mask offset was 1, and the mask entries in mask 412 are circulated downward by 3 rows relative to mask 410, because the mask offset was 3.

In the example of FIG. 9, the mask offset was always positive or zero. FIG. 10 shows another example of irregular page advances for three pass printing using a marking element array having nine marking elements. In this case the first page advance is PA=4, the second page advance is PA=1, and the third page advance is PA=4. This pattern is repeated cyclically as the printing of the image is continued. Since the normal mask position for pass 2 is at raster line 1×3=3, the mask offset is 3−4=−1, so that the mask entries in circulated mask 418 are circulated upward by 1 row relative to mask 410, and row A1 circulates to the bottom. After the second page advance of PA=1, the actual position of the mask is at raster line 5 (the sum of the page advances), while the normal position is at raster line 6, so the mask offset is 6−5=1. Therefore, the mask entries in circulated mask 419 are circulated downward by 1 row relative to mask 410.

Figure 11:
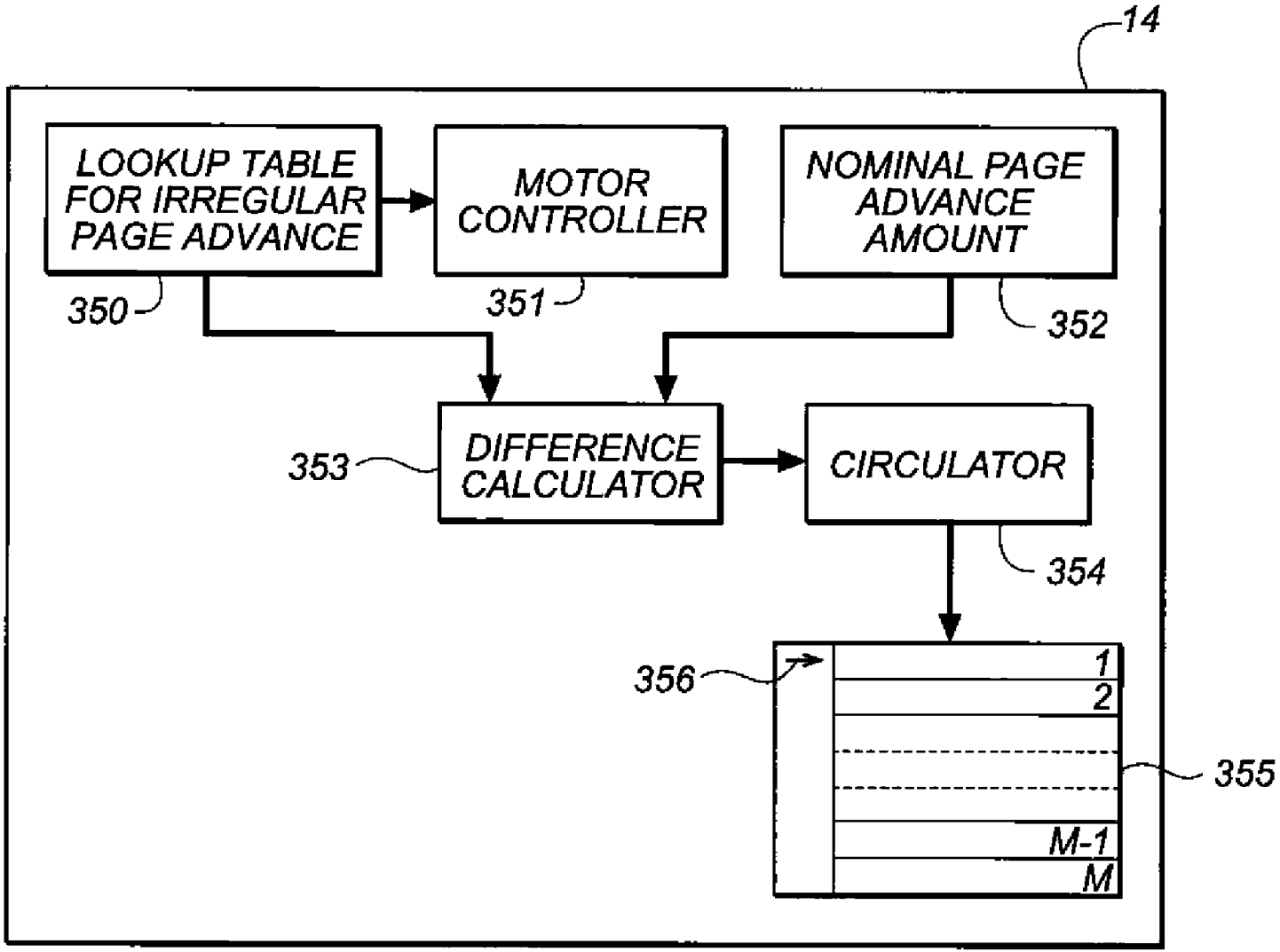
FIG. 11 schematically shows an embodiment of a printing system controller for nonuniform circulation of the rows of a print mask to compensate for irregular page advances.

With reference to FIGS. 3 and 11, embodiments of a printing system implementing the present invention include a printing system controller 14 that includes a lookup table 350 for specifying a sequence of irregular media advance amounts to the media advance subsystem (more particularly, to the motor controller 351 that controls the motor that powers feed roller 312) for a given m-pass print mode, and also includes a nominal media advance 352 that would be used if all of the media advance distances were equal for that m-pass print mode. Printing system controller 14 also includes a memory 355 that stores a single mask having M rows of print mask data for the given m-pass print mode. Memory 355 can be a circular buffer that includes a pointer 356 to indicate the top row of a working mask that is derived from the single mask by circulation of the rows. Printing system controller also includes a calculator 353 that calculates a difference between a present value of an irregular advance amount of the media (from lookup table 350) and the nominal media advance 352. This calculated difference is transmitted to a circulator 354 that incrementally circulates the single mask in memory 355 to provide a circulated working mask that compensates for the media being irregularly advanced. The circulator 354 can operate, for example, by moving the pointer 356 by a number of rows, where the sense of circulation and incremental number of rows are determined by the difference calculated by calculator 353.

The invention has been described in detail with particular reference to certain preferred embodiments thereof, but it will be understood that variations and modifications can be effected within the spirit and scope of the invention. In particular, while the examples have been for the case of single-tone printing where there can be only a single 1 per column of the mask in complementary mask sections, the method of nonuniform circulation of mask rows to compensate for irregular page advances can also be used for multi-tone printing where there can be more than a single 1 per column of the mask in the different mask sections.

PARTS LIST

10 Inkjet printer system
12 Image data source
14 Controller
15 Image processing unit
16 Electrical pulse source
18 First fluid source
19 Second fluid source
20 Recording medium
100 Ink jet printhead
110 to Ink jet printhead die
111 Substrate
120 First nozzle array
121 Nozzle in first nozzle array
122 Ink delivery pathway for first nozzle array
130 Second nozzle array
131 Nozzle in second nozzle array
132 Ink delivery pathway for second nozzle array
140 Marking element array
141-149 Marking elements
181 Droplet ejected from first nozzle array
182 Droplet ejected from second nozzle array
200 Carriage
250 Printhead chassis
251 Printhead die
253 Nozzle array
254 Nozzle array direction
256 Encapsulant
257 Flex circuit
258 Connector board
262 Multichamber ink supply
264 Single chamber ink supply
300 Printer chassis
302 Paper load entry
303 Print region
304 Media advance direction
305 Carriage scan direction
306 Right side of printer chassis
307 Left side of printer chassis
308 Front of printer chassis
309 Rear of printer chassis
310 Hole for paper advance motor drive gear
311 Feed roller gear
312 Feed roller
313 Forward rotation of feed roller
320 Pickup roller
322 Turn roller
323 Idler roller
324 Discharge roller
325 Star wheel
330 Maintenance station
350 Lookup table
351 Motor controller for media advance
352 Nominal media advance
353 Calculator
354 Circulator
355 Memory for mask
356 Pointer
370 Stack of media
371 Top sheet
380 Carriage motor
382 Carriage rail
383 Encoder fence
384 Belt
390 Printer electronics board
392 Cable connectors

What is claimed is:

1. A method for reducing banding artifacts in a printed image, comprising the steps of:

irregularly advancing a media that will be printed upon while employing an entire single mask for marking elements of a printhead;

calculating a difference between an irregular advance amount of the media versus a nominal advance amount of the media; and nonuniformly circulating the single mask by the difference calculated in order to compensate for the media being irregularly advanced.

2. The method claimed in claim 1, wherein nonuniformly circulating the single mask includes either a positive incremental circulation or a negative incremental circulation depending on whether the irregular advance is greater than or less than the nominal advance amounts respectively.

3. The method claimed in claim 1, wherein the single mask comprises m complementary mask sections; and wherein a sequence of m successive nonuniform circulations of the single mask restores a starting position for the single mask.

4. The method claimed in claim 3, wherein at least two of the m successive nonuniform circulations of the single mask correspond to a first irregular advance of the media and a second irregular advance of the media, wherein the second irregular advance of the media is unequal to the first irregular advance of the media.

5. A method for printing an image as a series of partially overlapping swaths of printed dots on a recording medium, the method comprising the steps of:

providing a printhead including an array of M marking elements disposed along an array direction, an effective distance between adjacent marking elements being equal to d;

providing a carriage to move the printhead along a carriage scan direction as the marking elements print on the recording medium, the carriage scan direction being substantially perpendicular to the array direction, such that an individual marking element is capable of printing dots along a line during one pass of the carriage relative to the recording medium;

providing a print mask $P_0$ including mask entries arranged in a total of M rows and m mask sections, the number of rows in each mask section being equal to M/m, and the mask entries in each of the m sections being complementary to each other;

providing print data corresponding to the image to be printed;

printing a swath $S_0$ of printed dots on the recording medium, the dot locations that are printed by individual marking elements being controlled by the print data and by print mask $P_0$;

advancing the recording medium in a media advance direction by a media advance distance $D_1$, the media advance direction being substantially parallel to the array direction, and the media advance distance $D_1=(M/m+n_1)d$, where n1 is an integer not equal to zero;

circulating the mask entries in print mask $P_0$ by an amount of $n_1$ rows to provide a circulated print mask $P_1$; and printing a swath $S_1$ of printed dots on the recording medium, the swath $S_1$ partially overlapping the swath $S_0$, wherein the dot locations that are printed by individual marking elements are controlled by the print data and the circulated print mask $P_1$.

6. The method claimed in claim 5, comprising further steps subsequent to the printing of the swath $S_1$, the further steps including:

advancing the recording medium in the media advance direction by a media advance distance $D_2$, the media advance distance $D_2$ being equal to $(M/m+n_2)d$, where $n_2$ is an integer;

circulating the mask entries in print mask $P_0$ by an amount of $(n_1+n_2)$ rows to provide a circulated print mask $P_2$; and printing a swath $S_2$ of printed dots on the recording medium, the swath $S_2$ partially overlapping the swath $S_1$, wherein the dot locations that are printed by individual marking elements are controlled by the print data and the circulated print mask $P_2$.

7. The method claimed in claim 5, the steps being iteratively continued m times to print swaths $S_0, S_1, S_2, \ldots S_m$, advancing the recording medium in the media advance direction between successive swaths by media advance distances $D_i=D_1, D_2, \ldots D_m$ respectively, wherein:

$$D_i=(M/m+n_i)d;$$

at least two values of $n_i$ are not equal to zero; and $$(n_1+n_2+\ldots+n_m)=0.$$

8. The method claimed in claim 5, the steps being iteratively continued m times to print swaths $S_0, S_1, S_2, \ldots S_m$, the dot locations in swath $S_i$ being printed by individual marking elements being controlled by the print data and circulated print mask $P_i$, wherein circulated print mask $P_m$ is the same as print mask $P_0$.

9. A printing system, comprising:

a printhead comprising an array of marking elements;

a carriage for moving the printhead in a carriage scan direction relative to a recording media;

a media advance subsystem for advancing the recording media;

a printing system controller, comprising:

d1) a lookup table for specifying a sequence of irregular media advance amounts to the media advance subsystem;

d2) a memory that stores a single print mask for specifying which of the marking elements of the printhead can print at a given location;

d3) a calculator for calculating a difference between an irregular advance amount of the media versus a nominal advance amount of the media; and d4) a circulator for circulating the single mask by the difference calculated in order to compensate for the media being irregularly advanced.

10. The printing system claimed in claim 9, wherein the printhead is an inkjet printhead.

* * * * *

UNITED STATES PATENT AND TRADEMARK OFFICE

CERTIFICATE OF CORRECTION

PATENT NO. : 7,845,751 B2
APPLICATION NO. : 12/251858
DATED : December 7, 2010
INVENTOR(S) : Christopher Rueby It is certified that error appears in the above-identified patent and that said Letters Patent is hereby corrected as shown below:

| Issued Patent | | Description of Error |
|---|---|---|
| **Column** | **Line** | |
| 14 | 27 | In Claim 2, delete "amounts" and insert -- amount, -- therefor. |
| 15 | 2 | In Claim 5, delete "n1" and insert -- $n_1$ -- therefor. |

Signed and Sealed this
Fifteenth Day of March, 2011

David J. Kappos

David J. Kappos
*Director of the United States Patent and Trademark Office*